US011124340B2

(12) United States Patent
Crawley

(10) Patent No.: US 11,124,340 B2
(45) Date of Patent: Sep. 21, 2021

(54) ANTI-THEFT STORAGE CONTAINER SYSTEM

(71) Applicant: Caren Crawley, Bronx, NY (US)

(72) Inventor: Caren Crawley, Bronx, NY (US)

( * ) Notice: Subject to any disclaimer, the term of this patent is extended or adjusted under 35 U.S.C. 154(b) by 0 days.

(21) Appl. No.: 16/786,199

(22) Filed: Feb. 10, 2020

(65) Prior Publication Data

US 2021/0245941 A1 Aug. 12, 2021

(51) Int. Cl.
*B65D 55/14* (2006.01)
*B65D 43/02* (2006.01)

(52) U.S. Cl.
CPC ..... *B65D 55/14* (2013.01); *B65D 43/0231* (2013.01); *B65D 2543/00092* (2013.01); *B65D 2543/00351* (2013.01); *B65D 2543/00527* (2013.01); *B65D 2543/00537* (2013.01)

(58) Field of Classification Search
CPC ..... B65D 55/14; B65D 43/0231; B65D 2543/00537; B65D 2543/00527; B65D 2543/00351; B65D 2543/00092
See application file for complete search history.

(56) References Cited

U.S. PATENT DOCUMENTS

| | | | | |
|---|---|---|---|---|
| 2,595,113 | A | 4/1942 | Taberer | |
| 3,093,238 | A | 6/1963 | King, III | |
| 3,331,522 | A | 7/1967 | Bridges | |
| 4,852,725 | A | 8/1989 | Folsom | |
| 5,094,363 | A | 3/1992 | Monahan et al. | |
| 5,251,542 | A | 10/1993 | Itoh | |
| D376,979 | S | 12/1996 | Davidson, III | |
| 5,598,792 | A | 2/1997 | Wales | |
| 6,003,718 | A | 12/1999 | Lu | |
| 7,866,505 | B2 | 1/2011 | Perlman et al. | |
| 8,938,999 | B2 | 1/2015 | Dahl | |
| 10,189,619 | B1 | 1/2019 | Crawley | |
| 10,872,482 | B1 * | 12/2020 | Colton | B65D 41/026 |
| 2006/0108364 | A1 | 5/2006 | Benktzon et al. | |
| 2007/0228042 | A1 | 10/2007 | Yeager | |
| 2008/0048461 | A1 * | 2/2008 | Jayasuriya | B60R 19/40 293/119 |
| 2009/0078607 | A1 | 3/2009 | Ballard | |
| 2015/0272825 | A1 * | 10/2015 | Lim | G07C 9/38 340/5.2 |
| 2018/0058812 | A1 * | 3/2018 | Gilbert | F41C 33/045 |
| 2019/0248555 | A1 * | 8/2019 | Cabouli | B65D 55/14 |

FOREIGN PATENT DOCUMENTS

| | | | | |
|---|---|---|---|---|
| WO | WO-0214635 A1 * | 2/2002 | | G07C 9/28 |

* cited by examiner

*Primary Examiner* — Nader Bolourchi

(57) ABSTRACT

Lockable storage container systems, such as container systems for food storage or storage of other items, that feature a biometric locking system to help prevent unwanted opening of the container. The systems herein comprise a storage housing and a removable lid, wherein a locking mechanism is controlled by the biometric locking system such that the lid is locked on the housing unless deactivated by the biometric locking system.

12 Claims, 4 Drawing Sheets

ANTI-THEFT STORAGE CONTAINER SYSTEM

BACKGROUND OF THE INVENTION

Field of the Invention

The present invention relates to containers for storage of food or other non-food items, more particularly to containers for storage that feature anti-theft mechanisms.

Background Art

The current design of food storage containers includes (but is not limited to) those that are cylindrical housings with attachable lids or others, such as cuboidal containers with attachable lids. The lids can be opened and closed to access or contain the contents therein.

BRIEF SUMMARY OF THE INVENTION

The present invention features storage container systems, such as container systems for food storage or storage of other items. The systems herein comprise a locking mechanism to help prevent unwanted opening of the container. For example, the storage container may feature a biometric locking system, e.g., a fingerprint pad, which when activated with the correct fingerprint unlocks the storage container.

Briefly, the present invention features storage container systems with biometric locks. In certain embodiments, the storage container system comprises: a storage housing with an inner cavity for holding food, liquid, or non-food items, the inner cavity is accessible via an opening in a top end of the storage housing; a lid removably attachable to the top end of the storage housing, the lid can move between at least an open position wherein the inner cavity of the storage housing is accessible and a closed position wherein the inner cavity of the storage housing is not accessible; a first threaded component disposed at the top end of the storage housing and a second threaded component disposed at a bottom end of the lid, wherein the first threaded component removably engages the second threaded component to prevent access to the inner cavity of the storage housing; a slot is disposed in the first threaded component; a tab housing disposed in the storage housing below the slot; a tab slidably disposed in the tab housing and operatively connected to a motor unit in the tab housing, the tab can move between an extended position wherein the tab extends through at least a portion of the slot and a retracted position wherein the tab does not extend through any portion of the slot, wherein the tab in the extended position blocks movement of the first threaded component and second threaded component with respect to each other, thereby preventing removal of the lid from the storage housing; a microprocessor with a memory unit that stores pre-recorded fingerprint data; and a fingerprint sensor pad disposed on an external surface of the storage housing and operatively connected to the microprocessor, the fingerprint sensor pad obtains fingerprint data from a user when the user contacts his finger to the fingerprint sensor pad, whereupon the fingerprint sensor pad sends the fingerprint data as a signal to the microprocessor; wherein upon receipt of the fingerprint data from the fingerprint sensor pad, the microprocessor is capable of storing the fingerprint data in the memory unit and/or comparing the fingerprint data with the pre-recorded fingerprint data stored in the memory unit, wherein if the fingerprint data from the user matches pre-recorded fingerprint data stored in the memory unit, the microprocessor sends a signal to the tab housing to activate the motor unit of the tab housing to cause the tab to move from the extended position to the retracted position so as to allow removal of the lid from the storage housing.

In certain embodiments, the storage container system comprises: a storage housing with an inner cavity for holding food, liquid, or non-food items, the inner cavity is accessible via an opening in a top end of the storage housing; a lid pivotally attached to a point at the top end of the storage housing via a hinge, the lid can move between at least an open position wherein the inner cavity of the storage housing is accessible and a closed position wherein the inner cavity of the storage housing is not accessible; a latch extending downwardly from a bottom end of the lid; a latch housing disposed at the top end of the storage housing, the latch can removably engage the latch housing to secure the lid in the closed position; a slot disposed in the latch; a tab housing disposed in the storage housing adjacent to the latch housing; a tab slidably disposed in the tab housing and operatively connected to a motor unit in the tab housing, the tab can move between an extended position wherein the tab extends through the latch housing and through at least a portion of the slot in the latch and a retracted position wherein the tab does not extend through any portion of the slot in the latch, wherein the tab in the extended position blocks disengagement of the latch from the latch housing, thereby preventing opening of the lid; a microprocessor with a memory unit that stores pre-recorded fingerprint data; a fingerprint sensor pad disposed on an external surface of the storage housing and operatively connected to the microprocessor, the fingerprint sensor pad obtains fingerprint data from a user when the user contacts his finger to the fingerprint sensor pad, whereupon the fingerprint sensor pad sends the fingerprint data as a signal to the microprocessor; wherein upon receipt of the fingerprint data from the fingerprint sensor pad, the microprocessor is capable of storing the fingerprint data in the memory unit and/or comparing the fingerprint data with the pre-recorded fingerprint data stored in the memory unit, wherein if the fingerprint data from the user matches pre-recorded fingerprint data stored in the memory unit, the microprocessor sends a signal to the tab housing to activate the motor unit of the tab housing to cause the tab to move from the extended position to the retracted position so as to allow opening of the lid.

In certain embodiments, the storage housing is cylindrical. In certain embodiments, the microprocessor is operatively connected to a battery. In certain embodiments, the battery is a rechargeable battery. In certain embodiments, the rechargeable battery is operatively connected to a charging port on the storage housing.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE SEVERAL VIEWS OF THE DRAWING(S)

The features and advantages of the present invention will become apparent from a consideration of the following detailed description presented in connection with the accompanying drawings in which.

DETAILED DESCRIPTION OF THE INVENTION

Figure 1:
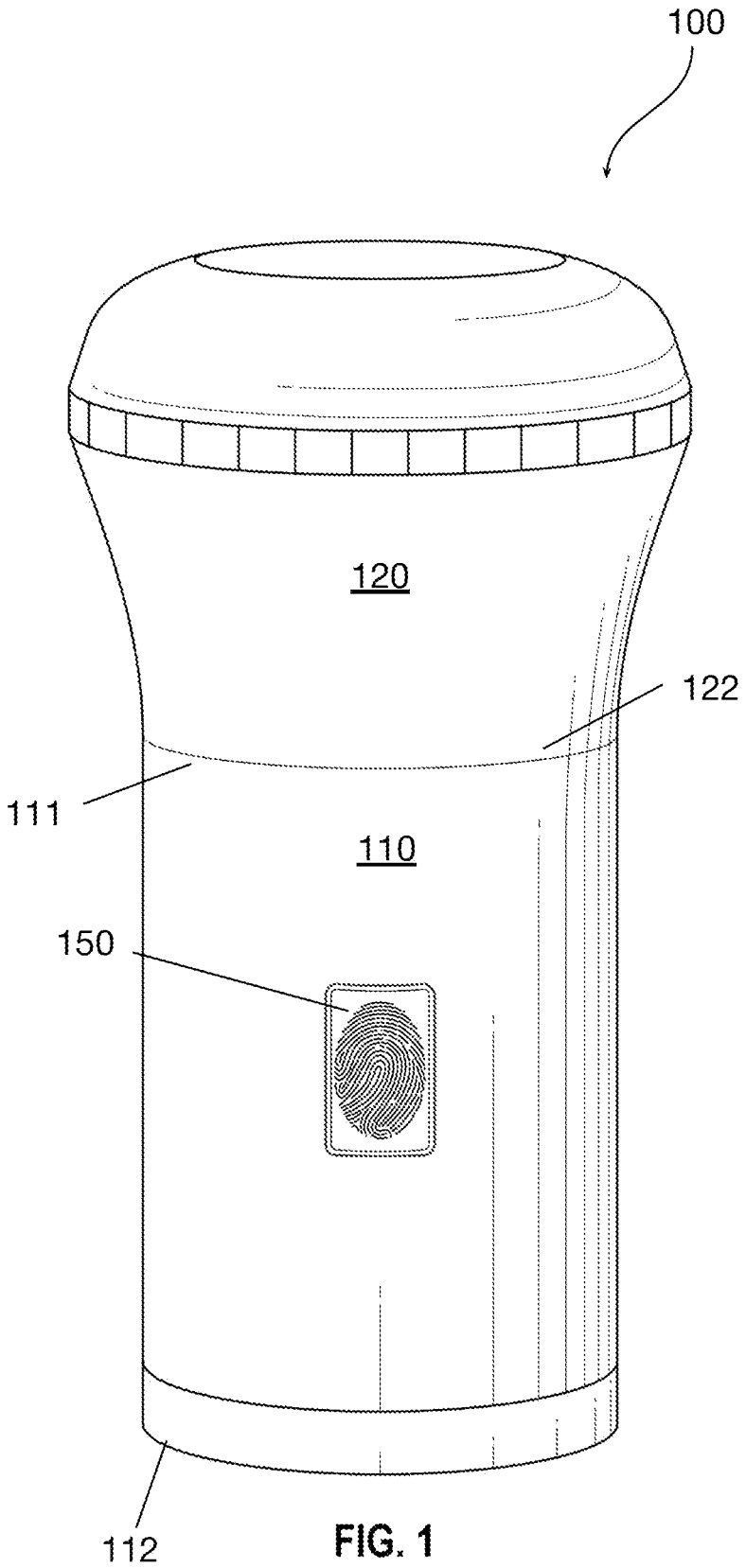
FIG. 1 shows a perspective view of an embodiment of the system of the present invention.

Following is a list of elements corresponding to a particular element referred to herein:

100 storage container system
110 storage housing
111 top end of storage housing
112 bottom end of storage housing
115 inner cavity of storage housing
120 removable lid
121 top end of removable lid
122 bottom end of removable lid
130*a* first threaded component
130*b* second threaded component
140 slot
142 tab
144 tab housing
150 fingerprint sensor pad
155 microprocessor
156 memory unit
157 battery
160 charging port
170 hinge
180 latch
182 latch housing
200 motor unit Unless specifically defined otherwise, all technical or scientific terms used herein have the same meaning as commonly understood by one of ordinary skill in the art to which this invention belongs.

The present invention features storage container systems, such as container systems for food storage or storage of other items. The storage container systems herein comprise a biometric locking mechanism to help prevent unwanted opening of the container.

Figure 2:
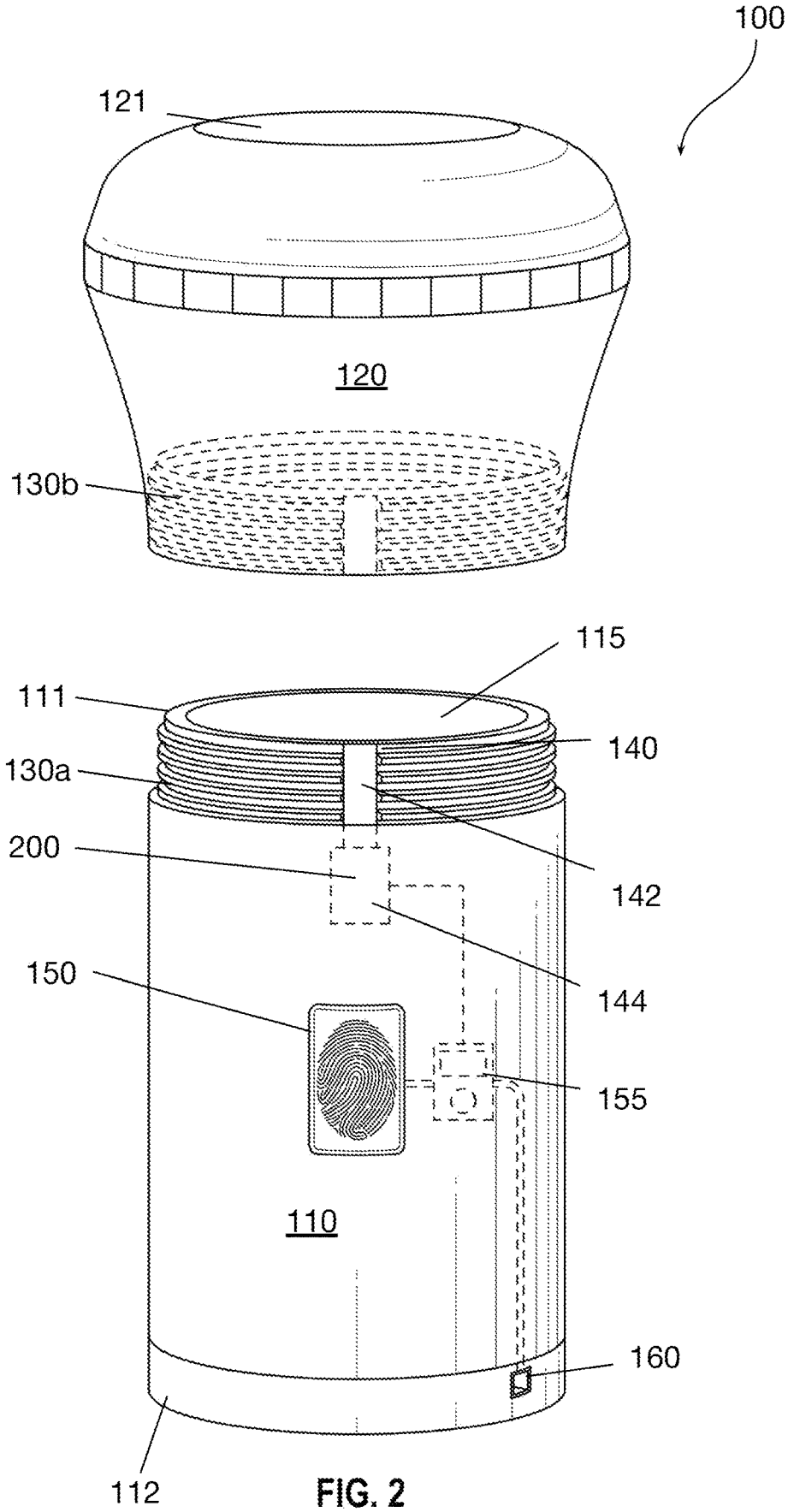
FIG. 2 shows a detailed perspective view of the embodiment of FIG. 1.

Referring to FIG. 1 and FIG. 2, the system (100) comprises a storage housing (110) with an inner cavity (115) for holding items such as foods, liquids, or other non-food items. The inner cavity (115) is accessible via an opening in the storage housing (110) at the top end (111) of the storage housing (110).

The storage housing (110) may be cylindrical, e.g., as shown in FIG. 1 and FIG. 2. However, the storage housing (110) is not limited to a cylindrical shape and may encompass any appropriate shape.

Figure 4:
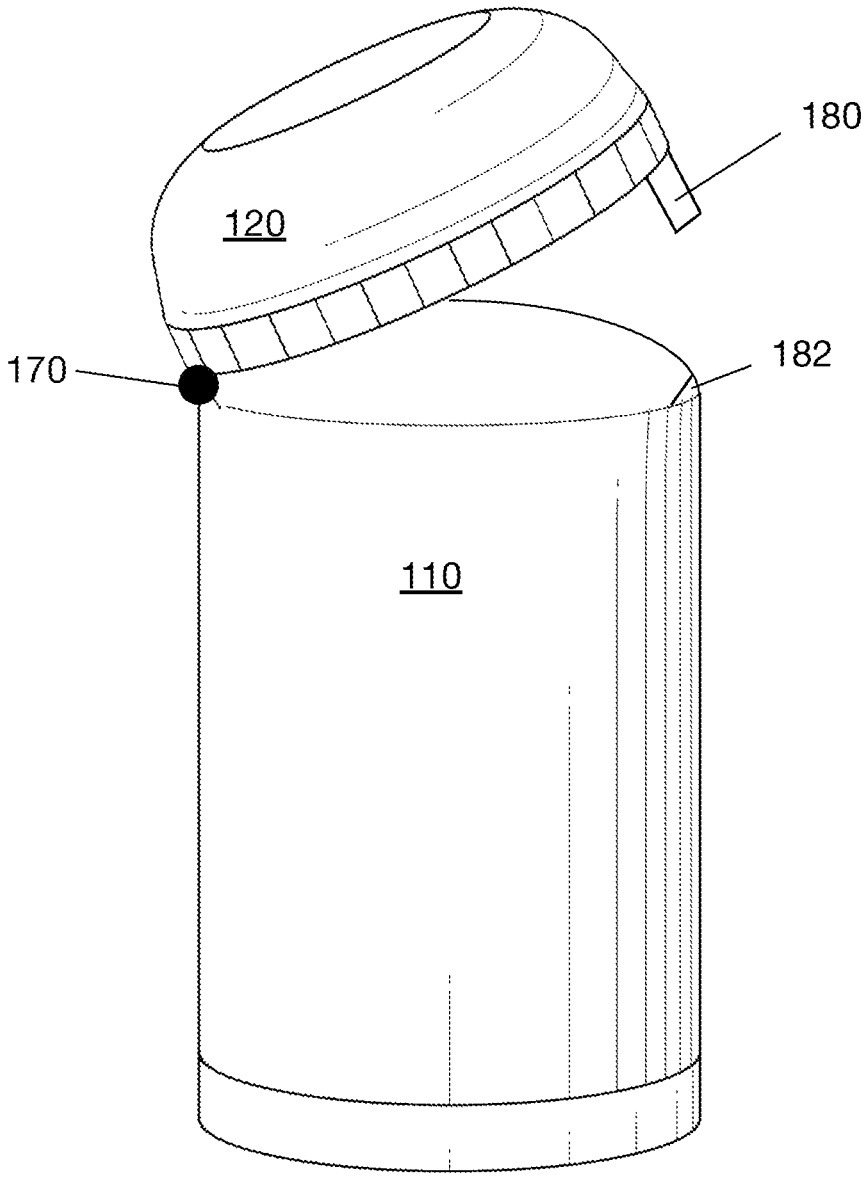
FIG. 4 shows a side view of an alternative embodiment of the system of the present invention. (Fingerprint pad not shown.)

The system (100) further comprises a removable lid (120), e.g., the bottom end (122) of the lid (120) can removably attach to the top end (110) of the storage housing (110). The lid (120) can move between at least an open position (wherein the inner cavity (115) of the storage housing (110) is accessible) and a closed position (wherein the inner cavity (115) of the storage housing (110) is not accessible). The mechanism by which the removable lid (120) attaches to the storage housing (110) may include but is not limited to a threaded mechanism, a latch mechanism, a hinge and latch mechanism, etc. For example, as shown in FIG. 2, in certain embodiments, the storage housing (110) comprises a first threaded component (130*a*) disposed at the top end (111) that engages a second threaded component (130*b*) disposed at the bottom end (122) of the lid (120). The threaded components (130) can be engaged to secure the contents of the storage housing (110) in the inner cavity (115). As shown in FIG. 4, in certain embodiments, the lid (120) is pivotally attached to a point on the top end (111) of the storage housing (110) via a hinge (170). Said embodiment further comprises a latch (180) extending downwardly from the bottom end (122) of the lid (120). The latch (180) can removably engage (e.g., snap into) a latch housing (182) disposed on the storage housing (110) at the top end (111) to secure the contents of the inner cavity (115) of the storage housing (110) therein.

Figure 3:
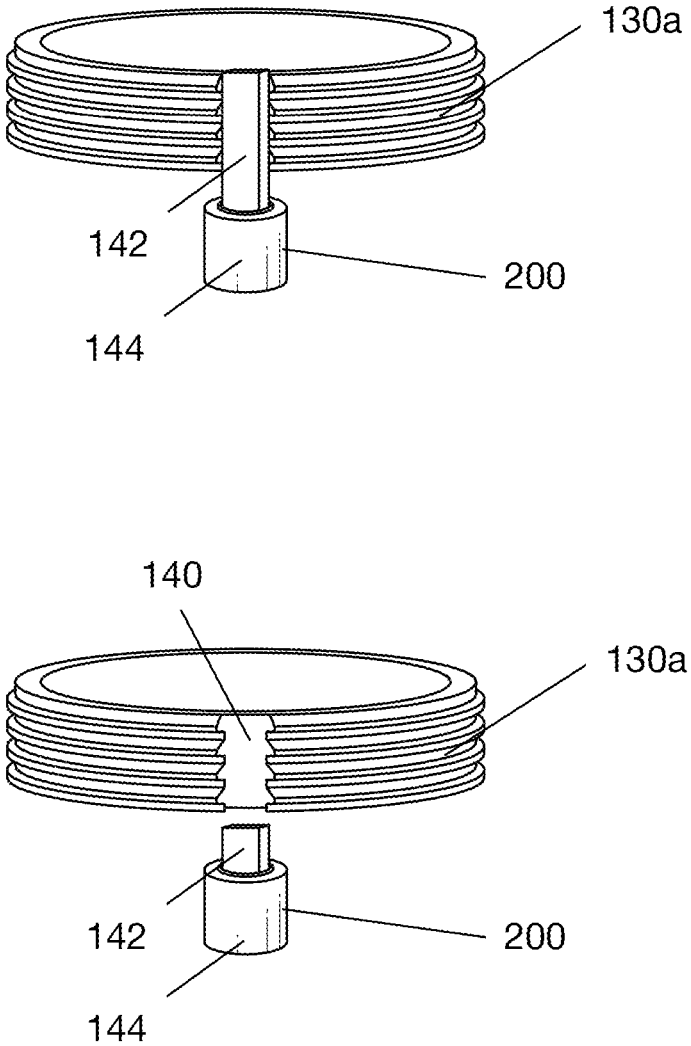
FIG. 3 shows a detailed view of a mechanism for locking the system of FIG. 1. The present invention is not limited to this embodiment.

Referring to FIG. 2 and FIG. 3, the system (100) further comprises a locking mechanism for locking the lid (120) in the closed position. In certain embodiments, a slot (140) is disposed in the first threaded component (130) at the top end (111) of the storage housing (110). As shown in FIG. 3, the slot (140) may be perpendicular to the axes of the first threaded component (130*a*). However, the present invention is not limited to this configuration. A tab (142) is slidably disposed in a tab housing (144) such that the tab (142) can move between an extended position wherein the tab (142) extends through at least a portion of the slot (140) (see FIG. 3, top drawing) and a retracted position wherein the tab (142) does not extend through any portion of the slot (140) (see FIG. 3, bottom drawing). When the tab (142) is in the extended position, the lid (120) cannot be twisted via the threaded components (130), e.g., the lid cannot be unscrewed because the tab (142) blocks movement of the lid (120) with respect to the storage housing (110). The tab housing (144) may be disposed in the side wall of the storage housing (110), e.g., just below the slot (140). The tab housing (144) features a motor unit (200) for providing the movement of the tab (142) between the extended and retracted positions.

In certain embodiments, a tab can engage the latch (180) of FIG. 4 and prevent movement (e.g., unlatching) of the latch to open the lid (120).

The system of the present invention further comprises a biometric locking system for preventing unwanted opening of the lid. The biometric locking system herein features a fingerprint sensor or pad (150) that detects fingerprints and a microprocessor (155) that may be capable of storing a detected fingerprint in a memory unit (156), and/or comparing the detected fingerprint with fingerprint data stored in the memory unit (156) to determine if the lid should be locked or unlocked. For reference to general biometric locking systems, the disclosures of the following documents are incorporated in their entirety by reference herein: U.S. Pat. Application No. 2003/0141959; U.S. Pat. Nos. 5,579,909; 5,701,770; 4,768,021; E.P. Pat. No. 0,976,897; and U.S. Pat. No. 5,794,466.

For example, as shown in FIG. 1 and FIG. 2, the system (100) comprises a fingerprint sensor pad (150) disposed on the storage housing (110), e.g., disposed on the outer surface of the side wall of the storage housing (110). The fingerprint sensor pad (150) is operatively connected to a microprocessor (155) with a memory unit (156) that stores fingerprint data and instructions to be executed by the microprocessor (155). The instructions stored in the memory unit may comprise instructions to store a detected fingerprint in the memory unit (156) and/or to compare a detected fingerprint signal to stored fingerprint data. The microprocessor (155) is also operatively connected to a battery (157), e.g., a rechargeable battery. In certain embodiments, the battery (157) is operatively connected to a charging port (160) that can be accessed on the outer surface of the storage housing (110). Charging ports and rechargeable batteries are well known to one of ordinary skill in the art.

The fingerprint sensor pad (150) is configured to read a fingerprint of a user and send the fingerprint signal to the microprocessor (155). In some embodiments, upon receipt of a fingerprint signal from the sensor pad (150), the microprocessor (155) may execute instructions stored in the memory unit (156) to store the fingerprint signal as fingerprint data in the memory unit (156). In other embodiments, upon receipt of a fingerprint signal from the sensor pad (150), the microprocessor (155) may execute instructions stored in the memory unit (156) to compare the fingerprint signal with the fingerprint data stored in the memory unit (156). If the fingerprint signal matches the fingerprint data stored in the memory unit (156), the microprocessor (155) sends a signal to the tab housing (144) to activate the tab housing (144), e.g., the motor unit (200) of the tab housing (144), and move the tab (142) from the extended position to the retracted position so as to allow removal of the lid (12) from the top end (111) of the storage housing (110). If the fingerprint signal does not match the fingerprint data stored in the memory unit (156), the microprocessor (155) does not send a signal to the tab housing (144) to activate the tab housing (144) and move the tab (142) from the extended position to the retracted position. Thus, the lid (120) cannot be removed unless the fingerprint signal matches the fingerprint data stored in the memory unit (156).

The system comprises electronic circuitry to allow for communication between the fingerprint sensor pad (150), microprocessor (155), memory unit (156), and tab housing (144).

Embodiments of the present invention can be freely combined with each other if they are not mutually exclusive.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting essentially of" or "consisting of", and as such the written description requirement for claiming one or more embodiments of the present invention using the phrase "consisting essentially of" or "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A storage container system (100) with biometric lock, said storage container system (100) comprising:

a. a storage housing (110) with an inner cavity (115) for holding food, liquid, or non-food items, the inner cavity (115) is accessible via an opening in a top end (111) of the storage housing (110);

b. a lid (120) removably attachable to the top end (111) of the storage housing (110), the lid (120) can move between at least an open position wherein the inner cavity (115) of the storage housing (110) is accessible and a closed position wherein the inner cavity (115) of the storage housing (110) is not accessible;

c. a first threaded component (130*a*) disposed at the top end (111) of the storage housing (110) and a second threaded component (130*b*) disposed at a bottom end (122) of the lid (120), wherein the first threaded component (130*a*) removably engages the second threaded component (130*b*) to prevent access to the inner cavity (115) of the storage housing (110);

d. a slot (140) is disposed in the first threaded component (130);

e. a tab housing (144) disposed in the storage housing (110) below the slot (140);

f. a motor unit (200) disposed in the tab housing (144);

g. a tab (142) slidably disposed in the tab housing (144) and operatively connected to the motor unit (200) in the tab housing (144), the tab (142) can move between an extended position wherein the tab (142) extends through at least a portion of the slot (140) and a retracted position wherein the tab (142) does not extend through any portion of the slot (140), wherein the tab (142) in the extended position blocks movement of the first threaded component (130*a*) and second threaded component (130*b*) with respect to each other, thereby preventing removal of the lid (120) from the storage housing (110), wherein activating the motor unit (200) causes the tab (142) to slide between the extended position and the retracted position;

h. a microprocessor (155) capable of executing instructions;

i. a memory unit (156) that stores pre-recorded fingerprint data and instructions; and j. a fingerprint sensor pad (150) disposed on an external surface of the storage housing (110) and operatively connected to the microprocessor (155), the fingerprint sensor pad (150) obtains fingerprint data from a user when the user contacts his finger to the fingerprint sensor pad (150), whereupon the fingerprint sensor pad (150) sends the fingerprint data as a signal to the microprocessor (155);

wherein upon receipt of the fingerprint data from the fingerprint sensor pad (150), the microprocessor (155) executes instructions stored in the memory unit (156) to store the fingerprint data in the memory unit (156); and wherein upon receipt of the fingerprint data from the fingerprint sensor pad (150), the microprocessor (155) executes instructions stored in the memory unit (156) to compare the fingerprint data with the pre-recorded fingerprint data stored in the memory unit (156), wherein if the fingerprint data from the user matches pre-recorded fingerprint data stored in the memory unit (156), the microprocessor (155) sends a signal to the tab housing (144) to the motor unit (200) of the tab housing (144) to activate the motor unit (200) to cause the tab (142) to move from the extended position to the retracted position so as to allow removal of the lid (12) from the storage housing (110).

2. The system (100) of claim 1, wherein the storage housing (110) is cylindrical.

3. The system (100) of claim 1, wherein the slot (140) is perpendicular to axes of the first threaded component (130*a*).

4. The system (100) of claim 1, wherein the tab housing (144) is disposed inside a side wall of the storage housing (110).

5. The system (100) of claim 1, wherein the microprocessor (155) is operatively connected to a battery (157).

6. The system (100) of claim 5, wherein the battery (157) is a rechargeable battery.

7. The system (100) of claim 6, wherein the rechargeable battery is operatively connected to a charging port (160) on the storage housing (110).

8. A storage container system (100) with biometric lock, said storage container system (100) comprising:

a. a storage housing (110) with an inner cavity (115) for holding food, liquid, or non-food items, the inner cavity (115) is accessible via an opening in a top end (111) of the storage housing (110);

b. a lid (120) pivotally attached to a point at the top end (111) of the storage housing (110) via a hinge (170), the lid (120) can move between at least an open position wherein the inner cavity (115) of the storage housing (110) is accessible and a closed position wherein the inner cavity (115) of the storage housing (110) is not accessible;

c. a latch (180) extending downwardly from a bottom end (122) of the lid (120);

d. a latch housing (182) disposed at the top end (111) of the storage housing (110), the latch (180) can removably engage the latch housing (182) to secure the lid (120) in the closed position;

e. a slot disposed in the latch (180);

f. a tab housing (144) disposed in the storage housing (110) adjacent to the latch housing (182);

g. a motor unit (200) disposed in the tab housing;

h. a tab (142) slidably disposed in the tab housing (144) and operatively connected to the motor unit (200) in the tab housing (144), the tab (142) can move between an extended position wherein the tab (142) extends through the latch housing (182) and through at least a portion of the slot in the latch (180) and a retracted position wherein the tab (142) does not extend through any portion of the slot in the latch (180), wherein the tab (142) in the extended position blocks disengagement of the latch (180) from the latch housing (182), thereby preventing opening of the lid (120), wherein activating the motor unit (200) causes the tab (142) to slide between the extended position and the retracted position;

i. a microprocessor (155) capable of executing instructions;

j. a memory unit (156) that stores pre-recorded fingerprint data and instructions; and k. a fingerprint sensor pad (150) disposed on an external surface of the storage housing (110) and operatively connected to the microprocessor (155), the fingerprint sensor pad (150) obtains fingerprint data from a user when the user contacts his finger to the fingerprint sensor pad (150), whereupon the fingerprint sensor pad (150) sends the fingerprint data as a signal to the microprocessor (155);

wherein upon receipt of the fingerprint data from the fingerprint sensor pad (150), the microprocessor (155) executes instructions stored in the memory unit (156) to store the fingerprint data in the memory unit (156); and wherein upon receipt of the fingerprint data from the fingerprint sensor pad (150), the microprocessor (155) executes instructions stored in the memory unit (156) to compare the fingerprint data with the pre-recorded fingerprint data stored in the memory unit (156), wherein if the fingerprint data from the user matches pre-recorded fingerprint data stored in the memory unit (156), the microprocessor (155) sends a signal to the tab housing (144) to the motor unit (200) of the tab housing (144) to activate the motor unit (200) to cause the tab (142) to move from the extended position to the retracted position so as to allow opening of the lid (12).

9. The system (100) of claim 1, wherein the storage housing (110) is cylindrical.

10. The system (100) of claim 1, wherein the microprocessor (155) is operatively connected to a battery (157).

11. The system (100) of claim 10, wherein the battery (157) is a rechargeable battery.

12. The system (100) of claim 11, wherein the rechargeable battery is operatively connected to a charging port (160) on the storage housing (110).

* * * * *